US007153096B2

(12) United States Patent
Thompson et al.

(10) Patent No.: US 7,153,096 B2
(45) Date of Patent: Dec. 26, 2006

(54) STACKED LAMINATE CMC TURBINE VANE

(75) Inventors: Daniel G. Thompson, Pittsburgh, PA (US); Steven James Vance, Orlando, FL (US); Jay A. Morrison, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 197 days.

(21) Appl. No.: 11/002,028

(22) Filed: Dec. 2, 2004

(65) Prior Publication Data

US 2006/0121265 A1 Jun. 8, 2006

(51) Int. Cl.
*F01D 9/00* (2006.01)

(52) U.S. Cl. ..... 415/200; 416/229 A; 428/293.4

(58) Field of Classification Search ..... 415/200; 416/223 A, 230, 229 A
See application file for complete search history.

(56) References Cited

U.S. PATENT DOCUMENTS

| | | | | |
|---|---|---|---|---|
| 3,301,526 | A | 1/1967 | Chamberlain | |
| 3,378,228 | A * | 4/1968 | Davies et al. | 416/229 A |
| 3,515,499 | A | 6/1970 | Beer et al. | |
| 3,554,663 | A | 1/1971 | Helms | |
| 3,584,972 | A | 6/1971 | Bratkovich | |
| 3,606,573 | A | 9/1971 | Emmerson et al. | |
| 3,619,077 | A | 11/1971 | Wile et al. | |
| 3,698,834 | A | 10/1972 | Meginnis | |
| 3,778,183 | A | 12/1973 | Luscher et al. | |
| 3,872,563 | A | 3/1975 | Brown et al. | |
| 4,105,364 | A | 8/1978 | Dodd | |
| 4,180,371 | A | 12/1979 | Ivanko | |
| 4,221,539 | A | 9/1980 | Corrigan | |
| 4,260,326 | A | 4/1981 | Scott et al. | |
| 4,314,794 | A | 2/1982 | Holden et al. | |
| 4,504,189 | A | 3/1985 | Lings | |
| 4,770,608 | A | 9/1988 | Anderson et al. | |
| 5,211,999 | A * | 5/1993 | Okada | 428/293.4 |
| 5,306,554 | A | 4/1994 | Harrison et al. | |
| 5,702,232 | A | 12/1997 | Moore | |
| 6,206,638 | B1 | 3/2001 | Glynn et al. | |
| 6,224,339 | B1 | 5/2001 | Rhodes et al. | |
| 6,235,370 | B1 | 5/2001 | Merrill et al. | |
| 6,322,322 | B1 | 11/2001 | Rhodes et al. | |
| 6,390,774 | B1 | 5/2002 | Lewis et al. | |
| 6,398,501 | B1 | 6/2002 | Darkins, Jr. et al. | |
| 6,478,535 | B1 | 11/2002 | Chung et al. | |
| 6,506,022 | B1 | 1/2003 | Bunker | |

(Continued)

FOREIGN PATENT DOCUMENTS

| | | | |
|---|---|---|---|
| EP | 0140257 | A1 | 5/1985 |

(Continued)

*Primary Examiner*—Richard A. Edgar

(57) ABSTRACT

Embodiments of the invention relate to a robust turbine vane made of stacked airfoil-shaped CMC laminates. Each laminate has an in-plane direction and a through thickness direction substantially normal to the in-plane direction. The laminates have anisotropic strength characteristics in which the in-plane tensile strength is substantially greater than the through thickness tensile strength. Thus, the laminates can provide strength in the direction of high thermal gradients and, thus, withstand the associated high thermal stresses. The laminates are relatively weak in through thickness (interlaminar) tension, but, in operation, relatively low through thickness tensile stresses can be expected. The laminates can be strong in through thickness compression; accordingly, the laminate stack can be held in through thickness compression by one or more fasteners. The CMC material can permit the inclusion of additional features such as cooling passages, ribs, spars, and thermal coatings, without compromising the strength characteristics of the material.

20 Claims, 10 Drawing Sheets

U.S. PATENT DOCUMENTS

| | | | |
|---|---|---|---|
| 6,574,966 | B1 | 6/2003 | Hidaka et al. |
| 6,589,010 | B1 | 7/2003 | Itzel et al. |
| 6,648,600 | B1 | 11/2003 | Takahashi et al. |
| 6,670,046 | B1 | 12/2003 | Xia |
| 2003/0059305 | A1 | 3/2003 | Bather et al. |

FOREIGN PATENT DOCUMENTS

| | | | |
|---|---|---|---|
| EP | 1001137 | A2 | 5/2000 |
| EP | 1065343 | A2 | 1/2001 |
| EP | 1091092 | A2 | 4/2001 |
| EP | 1239119 | A1 | 9/2002 |
| EP | 1245786 | A2 | 10/2002 |
| EP | 1267038 | A2 | 12/2002 |
| EP | 1319803 | A2 | 6/2003 |
| EP | 1361337 | A1 | 11/2003 |
| EP | 1367223 | A2 | 12/2003 |
| JP | 59113204 | A2 | 6/1984 |
| WO | WO 01/12361 | A2 | 2/2001 |
| WO | WO 03/026887 | A2 | 4/2003 |
| WO | WO 03042503 | A1 | 5/2003 |

* cited by examiner

STACKED LAMINATE CMC TURBINE VANE

FIELD OF THE INVENTION

The invention relates in general to turbine engines and, more specifically, to stationary airfoils in a turbine engine.

BACKGROUND OF THE INVENTION

A variety of materials and construction methods have been used in connection with turbine airfoils. For example, laminated airfoil concepts are known that use monolithic ceramic materials. Reasons for using such constructions include the reduction of impact stresses, reduction of thermally induced stresses from differential cooldown rates (e.g., thin trailing edge sections versus thicker sections), and accommodation of attachment to metals. However, precise and costly machining of individual laminates preclude the viability of these concepts.

Another type of material used in connection with turbine airfoils is ceramic matrix composites (CMC). CMC includes a ceramic matrix reinforced with ceramic fibers. In one CMC airfoil construction, fabric layers are wrapped over each other so that the fibers are primarily aligned substantially parallel to the surface of the component. For a 0/90 degree fabric lay-up, the fibers in the vane would substantially be oriented parallel to the gas path around the vane and along the vane radially to the machine. Furthermore, the reinforcing fibers are continuous and form an integral shell.

CMC airfoil designs can provide advantages over the monolithic airfoils described above. For example, the higher strength and toughness of CMCs can resolve the impact and thermal stress issues associated with monolithic ceramics, and their superior strain tolerance makes them more amenable to attachment to metal structures.

While providing some advantages over monolithic ceramics, the use of CMC materials in airfoil design introduce a new set of challenges. For example, CMC materials suffer from their low interlaminar tensile and shear strengths, which present special challenges in situations where an internally cooled component, such as a turbine vane, experiences large through thickness thermal gradients and the resultant high thermal stresses. In the above-described CMC airfoil construction, high thermal gradients cause high interlaminar tension (i.e. high stresses) in the weakest direction of the CMC material, resulting in delamination of the CMC.

Prior attempts to mitigate these stresses include three dimensional fiber reinforcement and exotic cooling methods. However, these approaches carry numerous development and manufacturing disadvantages and performance penalties.

Further, prior CMC airfoil constructions pose various manufacturing challenges. For instance, current oxide CMCs exhibit anisotropic shrinkage during curing, resulting in interlaminar stress buildup for constrained geometry shapes. Further complicating matters is that non-destructive evaluation methods to discover interlaminar defects are difficult on large, complex shapes such as gas turbine vanes. In addition, dimensional control is unproven for complex shapes and may be difficult to achieve in close-toleranced parts such as airfoils. Further, achievement of target material properties in large and/or complex shapes has proved to be difficult. There are also scale-ability limitations as current processes are labor-intensive, requiring very skilled technicians to carefully hand lay-up each reinforcing layer. Conventional lay-up techniques provide low pressure containment capability for trailing edge regions. In one example, the reinforcing fabric wrapped around the pressure and suction sides of the vane meet at the trailing edge where they become tangent to each other and are bonded together in the same manner as each layer is bonded to the adjacent layer. Consequently, the trailing edge is only weakly held together and is vulnerable to the pressure of the cooling air in the trailing edge exit holes.

SUMMARY OF THE INVENTION

Thus, there is a need for a vane that can address the problems encountered in prior CMC airfoil design and construction. Specifically, there is a need for a stacked CMC laminate vane that aligns the reinforcing fibers in the anticipated direction of high thermal stresses, thereby pitting strength against stress. Ideally, the construction can allow for the inclusion of enhanced cooling and structural features.

In one respect, embodiments of the invention are directed to a ceramic matrix composite laminate. The laminate has an airfoil-shaped outer peripheral surface. In addition, the laminate has an in-plane direction and a through thickness direction; the through thickness direction being substantially normal to the in-plane direction. The laminate is made of a ceramic matrix composite (CMC) material having anisotropic properties. Specifically, the in-plane tensile strength of the laminate is substantially greater than the through thickness tensile strength of the laminate. For instance, the in-plane tensile strength can be at least three times greater than the through thickness tensile strength.

The CMC material can include a ceramic matrix hosting a plurality of reinforcing fibers therein. In one embodiment, substantially all of the fibers can be oriented substantially in the in-plane direction of the laminate. Further, a first portion of the fibers can extend in a first in-plane direction, and a second portion of the fibers can extend in a second in-plane direction, which can be oriented at about 90 degrees relative to the first in-plane direction.

In one embodiment, the laminate can include a series of through thickness holes extending about at least a portion of the laminate. The holes can be proximate to the outer peripheral surface. These holes can be used as cooling passages. The laminate can also include one or more through thickness cutouts so as to form ribs or spars in the laminate.

The laminate can have recesses, serrations and/or cutouts about at least a portion of the outer peripheral surface. Further, the outer peripheral surface can be tapered.

In other respects, embodiments of the invention relate to an assembly in which a plurality of airfoil-shaped laminates are radially stacked so as to define a turbine vane. The vane has an outer peripheral surface as well as an associated planar direction and radial direction. The radial direction is substantially normal to the planar direction. Each laminate is made of an anisotropic CMC material such that the planar tensile strength of the vane is substantially greater than the radial tensile strength of the vane. In one embodiment, the planar tensile strength can be at least three times greater than the radial tensile strength.

The CMC material can include a ceramic matrix and a plurality of fibers therein. In one embodiment, substantially all of the fibers are oriented substantially in the planar direction of the vane. The fibers can be arranged in any of a number of ways. For instance, the fibers can be arranged in two planar directions in the vane. For example, a first portion of the fibers can extend in a first planar direction, and a second portion of the fibers can extend in a second planar direction. The first and second planar directions can be oriented at about 90 degrees relative to each other.

In another embodiment, at least one pair of adjacent laminates in the stack can have a unidirectional fiber arrangement. The pair of laminates includes a first laminate and a second laminate. In the first laminate, substantially all of the fibers can extend in a first planar direction. In the second laminate, substantially all of the fibers can extend in a second planar direction. The first and second planar directions can be oriented at about 90 degrees relative to each other.

A vane assembly according to embodiments of the invention can include a number of features. For instance, the vane assembly can include series of radial holes extending about at least a portion of the vane. The holes can be proximate to the outer peripheral surface. Thus, a coolant can pass through the radial holes so as to cool the outer peripheral surface of the vane. Further, at least one of the plurality of laminates can include one or more radial cutouts so as to form ribs or spars in the laminate.

The plurality of laminates can be held together in several ways. For instance, at least one pair of adjacent laminates can be joined by co-processing, sintering and/or by applying bonding material between the laminate pair. In another embodiment, a fastening system can be provided for holding the plurality of laminates in radial compression. In one embodiment, the fastening system can include an elongated fastener and a retainer. The fastener can extend through a radial opening provided in the vane. At least one end of the fastener can be closed by the retainer. In some embodiments, a stiffened fastening system may be desired, for example, to minimize concerns of radial creep of the fasteners and laminates. The stiffened fastening system can include at least two tie rods extending radially through one or more openings provided in the vane. The tie rods can be joined so as to form a single rigid fastener. The ends of the tie rods can be closed by retainers so as to hold the plurality of laminates in radial compression.

The laminates can be shaped or stacked to form an irregular outer peripheral surface of the vane. For example, the plurality of laminates can include alternating large laminates and small laminates so as to form a vane having a stepped outer peripheral surface. One or more laminates can be staggered from the other laminates to form an irregular outer peripheral surface. In another embodiment, at least two of the laminates in the stack can have a tapered outer peripheral edge. In such case, the two laminates can be stacked such that the tapered edge of each laminate can extend in substantially the same direction or in substantially opposite directions. Yet another manner of forming a vane with an irregular outer peripheral surface is by providing at least one laminate with recesses, serrations, and/or cutouts about at least a portion of the outer peripheral surface of the laminate. A thermal insulating material can be applied over the outer peripheral surface of the vane. Any of the above irregular outer peripheral surfaces can, among other things, facilitate bonding of a thermal insulating material over the stepped outer peripheral surface of the vane.

If needed, the trailing edge of a vane assembly according to embodiments of the invention can be cooled. A radial coolant supply opening can be provided in the vane. Each of the laminates can have a leading edge and a trailing edge. At least one of the laminates can include a channel extending from the trailing edge and into fluid communication with the coolant supply opening.

DETAILED DESCRIPTION OF EMBODIMENTS OF THE INVENTION

Embodiments of the present invention address the shortcomings of earlier stacked laminate vane designs by providing a robust vane that makes use of the anisotropic strength orientations of ceramic matrix composite (CMC) materials such that the high stresses inherent in a cooled vane are aligned with the strongest material direction, while the stresses in the weakest material direction are minimized. Embodiments of the invention will be explained in the context of one possible turbine vane, but the detailed description is intended only as exemplary. Embodiments of the invention are shown in FIGS. 1–16, but the present invention is not limited to the illustrated structure or application.

Figure 1:
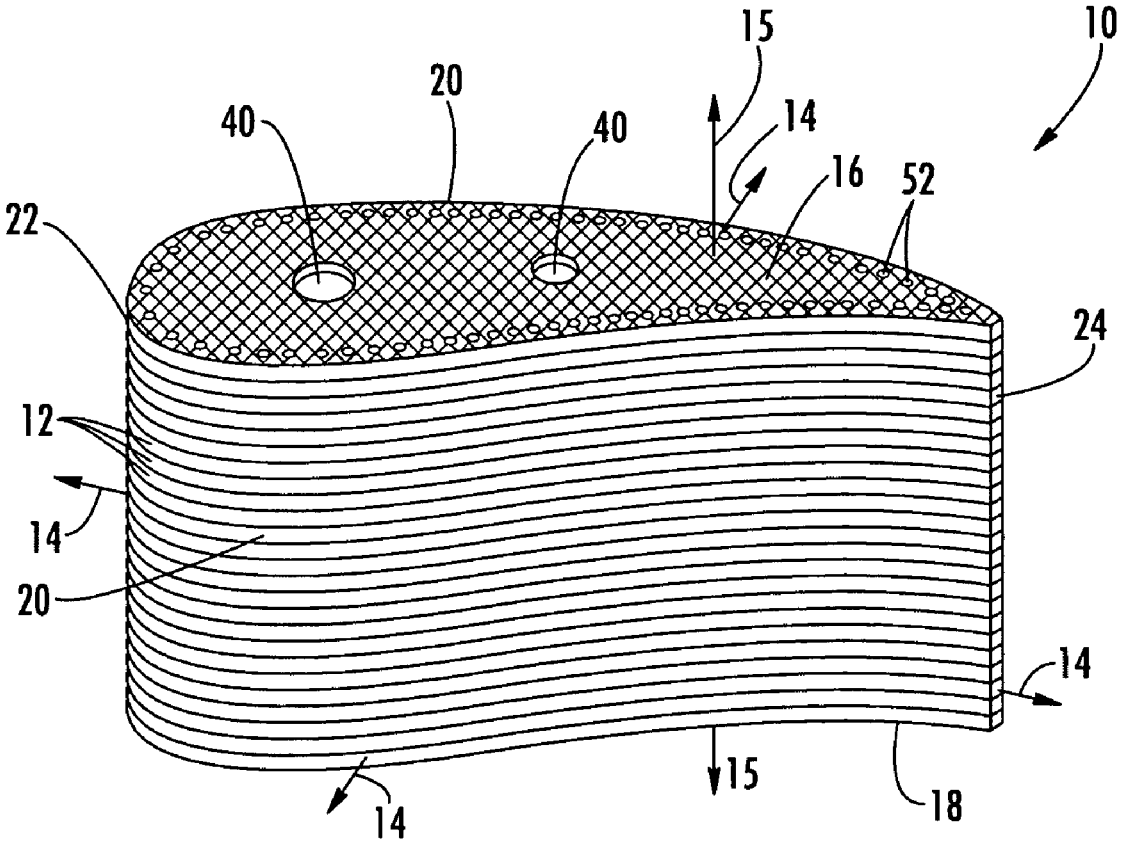
FIG. 1 is an isometric view of a turbine vane formed by a plurality of CMC laminates according to aspects of the invention.

FIG. 1 shows one possible construction of a turbine vane assembly 10 according to aspects of the invention. The vane 10 can be made of a plurality of CMC laminates 12. The vane 10 can have a radially outer end 16 and a radially inner end 18 and an outer peripheral surface 20. The term "radial," as used herein, is intended to describe the direction of the vane 10 in its operational position relative to the turbine. Further, the vane assembly 10 can have a leading edge 22 and a trailing edge 24.

The individual laminates 12 of the vane assembly 10 can be substantially identical to each other; however, one or more laminates 12 can be different from the other laminates 12 in the vane assembly 10. Each laminate 12 can be airfoil-shaped. The term airfoil-shaped is intended to refer to the general shape of an airfoil cross-section and embodiments of the invention are not limited to any specific airfoil shape. Design parameters and engineering considerations can dictate the needed cross-sectional shape for a given laminate 12.

Figure 2:
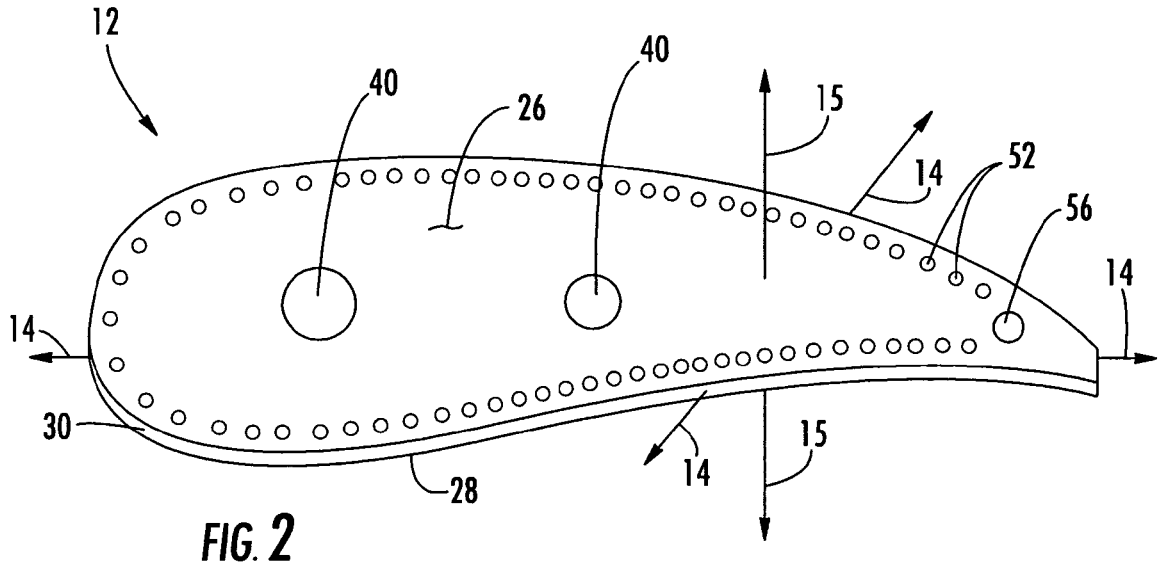
FIG. 2 is an isometric view of a single CMC laminate according to aspects of the invention.
Figure 3:
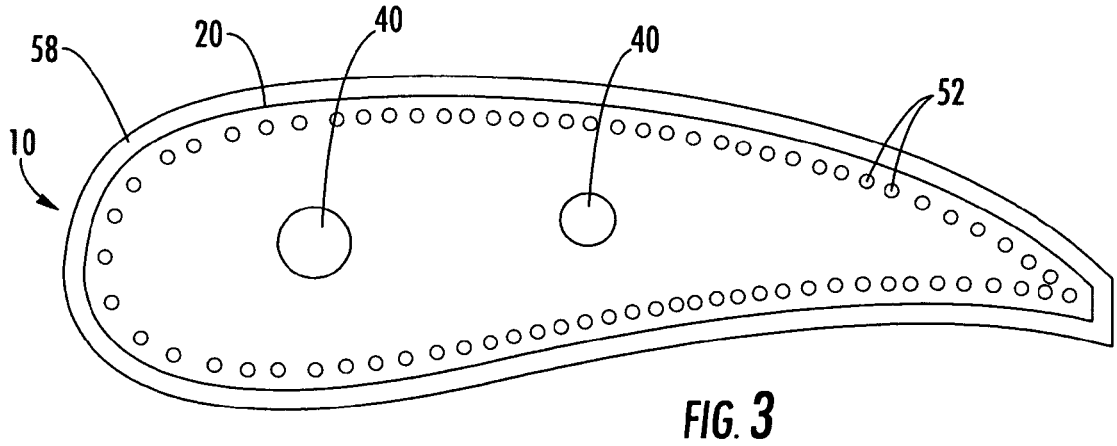
FIG. 3 is a top plan view of a turbine vane formed by a plurality of CMC laminates according to aspects of the invention, showing a thermal insulating material covering the outer peripheral surface of the vane.

Each laminate 12 can be substantially flat. Each laminate 12 can have a top surface 26 and a bottom surface 28 as well as an outer peripheral edge 30, as shown in FIG. 2. To facilitate discussion, each laminate 12 has an in-plane direction 14 and a through thickness direction 15. The through thickness direction 15 can be substantially normal to the in-plane direction 14. The through thickness direction 15 extends through the thickness of the laminate 12 between the top surface 26 to the bottom surface 28 of the laminate 12, preferably substantially parallel to the outer peripheral edge 30 of the laminate 12. In contrast, the in-plane direction 14 generally refers to any of a number of directions extending through the edgewise thickness of the laminate 12; that is, from one portion of the outer peripheral edge 30 to another portion of the outer peripheral edge 30. Preferably, the in-plane direction is substantially parallel to at least one of the top surface 26 and bottom surface 28 of the laminate 12.

As will be described in greater detail below, the laminates 12 can be made of a ceramic matrix composite (CMC) material. A CMC material comprises a ceramic matrix 32 that hosts a plurality of reinforcing fibers 34. The CMC material can be anisotropic at least in the sense that it can have different strength characteristics in different directions. Various factors, including material selection and fiber orientation, can affect the strength characteristics of a CMC material.

A CMC laminate 12 having anisotropic strength characteristics according to embodiments of the invention can be made of a variety of materials, and embodiments of the invention are not limited to any specific materials so long as the target anisotropic properties are obtained. In one embodiment, the CMC can be from the oxide-oxide family. In one embodiment, the ceramic matrix 32 can be, for example, alumina. The fibers 34 can be any of a number of oxide fibers. In one embodiment, the fibers 34 can be made of Nextel™ 720, which is sold by 3M, or any similar material. The fibers 34 can be provided in various forms, such as a woven fabric, blankets, unidirectional tapes, and mats. A variety of techniques are known in the art for making a CMC material, and such techniques can be used in forming a CMC material having strength directionalities in accordance with embodiments of the invention.

As mentioned earlier, fiber material is not the sole determinant of the strength properties of a CMC laminate. Fiber direction can also affect the strength. In a CMC laminate 12 according to embodiments of the invention, the fibers 34 can be arranged to provide the vane assembly 10 with the desired anisotropic strength properties. More specifically, the fibers 34 can be oriented in the laminate 12 to provide strength or strain tolerance in the direction of high thermal stresses or strains. To that end, substantially all of the fibers 34 can be provided in the in-plane direction 14 of the laminate 12; however, a CMC material according to embodiments of the invention can have some fibers 34 in the through thickness direction as well. "Substantially all" is intended to mean all of the fibers 34 or a sufficient majority of the fibers 34 so that the desired strength properties are obtained. Preferably, the fibers 34 are substantially parallel with at least one of the top surface 26 and the bottom surface 28 of the laminate 12.

When discussing fiber orientation, a point of reference is needed. For purposes of discussion herein, the chord line 36 of the laminate 12 will be used as the point of reference; however, other reference points can be used as will be appreciated by one skilled in the art and aspects of the invention are not limited to a particular point of reference. The chord line 36 can be defined as a straight line extending from the leading edge 22 to the trailing edge 24 of the airfoil shaped laminate 12. In the planar direction 14, the fibers 34 of the CMC laminate 12 can be substantially unidirectional, substantially bidirectional or multi-directional.

Figure 9:
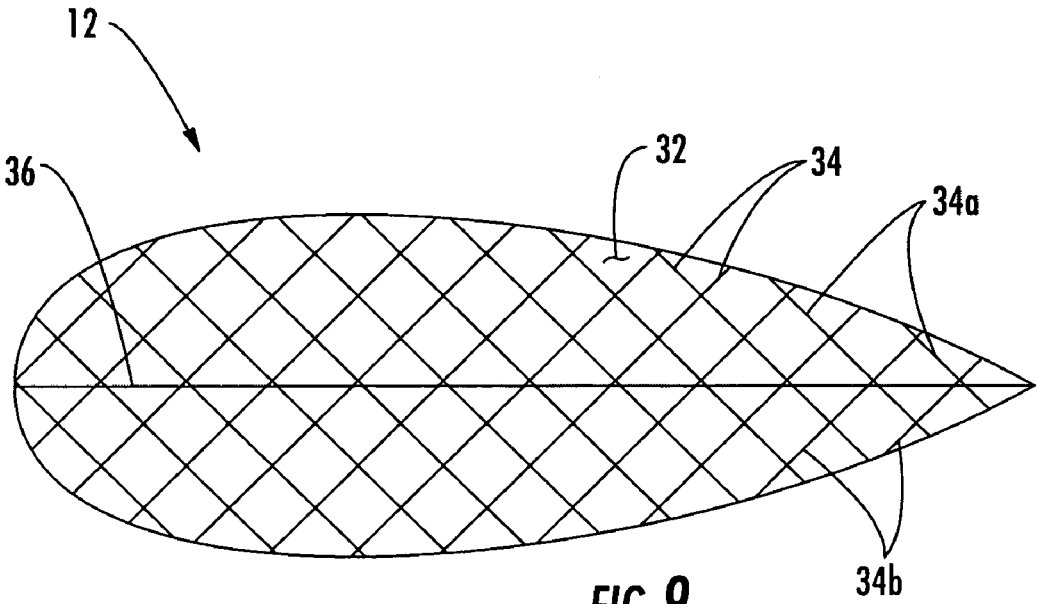
FIG. 9 is a top plan view of a CMC laminate according to aspects of the invention, showing a bi-directional network of fibers throughout the laminate oriented in the in-plane directions.
Figure 10:
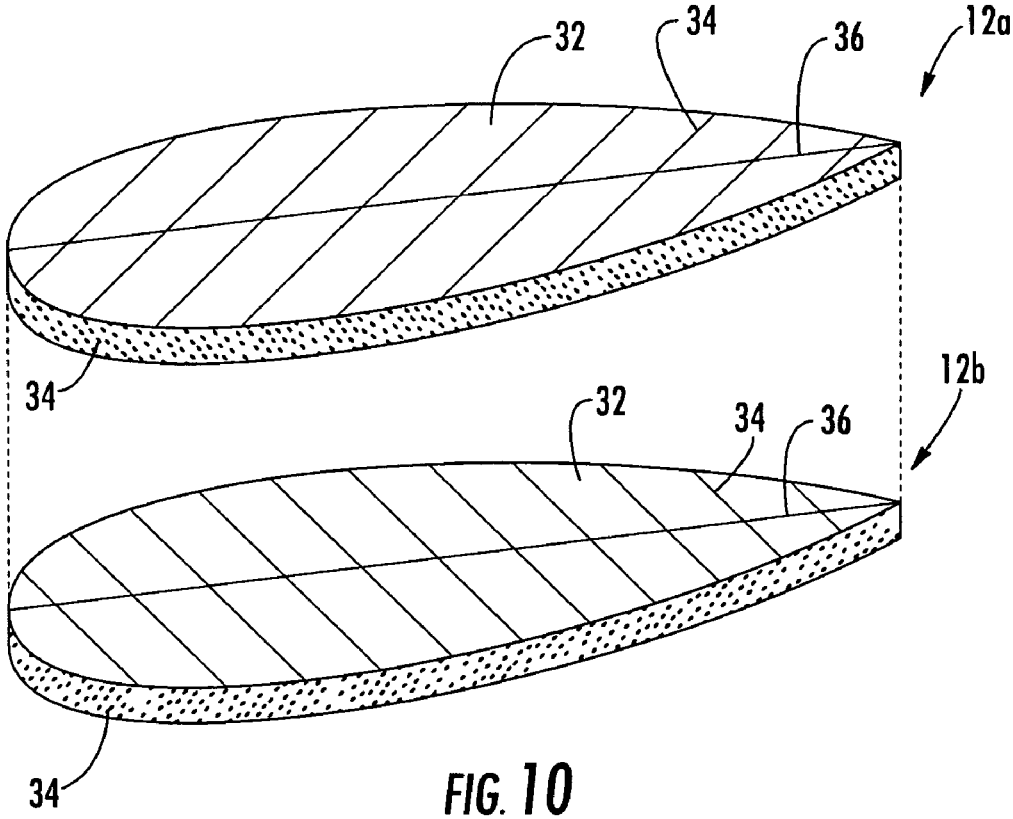
FIG. 10 is an exploded isometric view of two adjacent laminates in a turbine vane according to embodiments of the invention, showing one laminate having the fibers oriented in a first planar direction and another laminate having fibers oriented in a second planar direction that is substantially 90 degrees relative to the first planar direction.

In a bi-directional laminate, like the laminate 12 shown in FIG. 9, one portion of the fibers 34 can extend at one angle relative to the chord line 36 and another portion of the fibers 34 can extend at a different angle relative to the chord line 36 such that the fibers 34 cross. A preferred bi-directional fiber network includes fibers 34 that are oriented at about 90 degrees relative to each other, but other relative orientations are possible, such as at about 30 or about 60 degrees. In one embodiment, a first portion of the fibers 34*a* can be oriented at about 45 degrees relative to the chord line 36 of the laminate 12, while a second portion of the fibers 34*b* can be oriented at about −45 degrees (135 degrees) relative to the chord line 36, as shown in FIG. 9. Other possible relative fiber arrangements include: fibers 34 at about 30 and about 120 degrees, fibers 34 at 60 and 150 degrees, and fibers 34 at about 0 degrees and about 90 degrees relative to the chord line. These orientations are given in the way of an example, and embodiments of the invention are not limited to any specific fiber orientation. Indeed, the fiber orientation can be optimized for each application depending at least in part on the cooling system, temperature distributions and the expected stress field for a given vane.

As noted earlier, the fibers 34 can be substantially unidirectional, that is, all of the fibers 34 or a substantial majority of the fibers 34 can be oriented in a single direction. For example, the fibers 34 in one laminate can all be substantially aligned at, for example, 45 degrees relative to the chord line 36, such as shown in the laminate 12*a* in FIG. 10. However, in such case, it is preferred if at least one of the adjacent laminates is also substantially uni-directional with fibers 34 oriented at about 90 degrees in the opposite direction. For example, the laminate 12*b* in FIG. 10 includes fibers 34 oriented at about 45 degrees (135 degrees) relative to the chord line 36. In the context of a vane assembly 10, such alternation can repeat throughout the vane assembly or can be provided in local areas.

Aside from the particular materials and the fiber orientations, the CMC laminates 12 according to embodiments of the invention can be defined by their anisotropic properties. For example, the laminates 12 can have a tensile strength in the in-plane direction 14 that is substantially greater than the tensile strength in the through thickness direction 15. In one embodiment, the in-plane tensile strength can be at least three times greater than the through thickness tensile strength. In another embodiment, the ratio of the in-plane tensile strength to the through thickness tensile strength of the CMC laminate can be about 10 to 1. In yet another embodiment, the in-plane tensile strength can be from about 25 to about 30 times greater than the through thickness tensile strength. Such unequal directionality of strengths in the laminates 12 is desirable for reasons that will be explained later.

One particular CMC laminate 12 according to embodiments of the invention can have an in-plane tensile strength from about 150 megapascals (MPa) to about 200 MPa in the fiber direction and, more specifically, from about 160 MPa to about 184 MPa in the fiber direction. Further, such a laminate 12 can have an in-plane compressive strength from about 140 MPa to 160 MPa in the fiber direction and, more specifically, from about 147 MPa to about 152 MPa in the fiber direction.

This particular CMC laminate 12 can be relatively weak in tension in the through thickness direction. For example, the through thickness tensile strength can be from about 3 MPa to about 10 MPa and, more particularly, from about 5 MPa to about 6 MPa, which is substantially lower than the in-plane tensile strengths discussed above. However, the laminate 12 can be relatively strong in compression in the through thickness direction. For example, the through thickness compressive strength of a laminate 12 according to embodiments of the invention can be from about −251 MPa to about −314 MPa.

The above strengths can be affected by temperature. Again, the above quantities are provided merely as examples, and embodiments of the invention are not limited to any specific strengths in the in-plane or through thickness directions.

As noted earlier, a vane assembly 10 according to embodiments of the invention can be formed by a stack of CMC laminates 12. Up to this point, the terms "in-plane" and "through thickness" have been used herein to facilitate discussion of the anisotropic strength characteristics of a CMC laminate in accordance with embodiments of the invention. While convenient for describing an individual laminate 12, such terms may become awkward when used to describe strength directionalities of a turbine vane 10 formed by a plurality of stacked laminates according to embodiments of the invention. For instance, the "in-plane direction" associated with an individual laminate generally corresponds to the axial and circumferential directions of the vane assembly 10 in its operational position relative to the turbine. Similarly, the "through thickness direction" generally corresponds to the radial direction of the vane assembly 10 relative to the turbine. Therefore, in connection with a turbine vane 10, the terms "radial" or "radial direction" will be used in place of the terms "through thickness" or "through thickness direction." Likewise, the terms "planar" or "planar direction" will be used in place of the terms "in-plane" and "in-plane direction."

With this understanding, the plurality of laminates 12 can be substantially radially stacked to form the vane assembly 10 according to embodiments of the invention. The outer peripheral edges 30 of the stacked laminates 12 can form the exterior surface 20 of the vane assembly 10. As noted earlier, the individual laminates 12 of the vane assembly 10 can be substantially identical to each other. Alternatively, one or more laminates 12 can be different from the other laminates 12 in a variety of ways including, for example, thickness, size, and/or shape.

Figure 7:
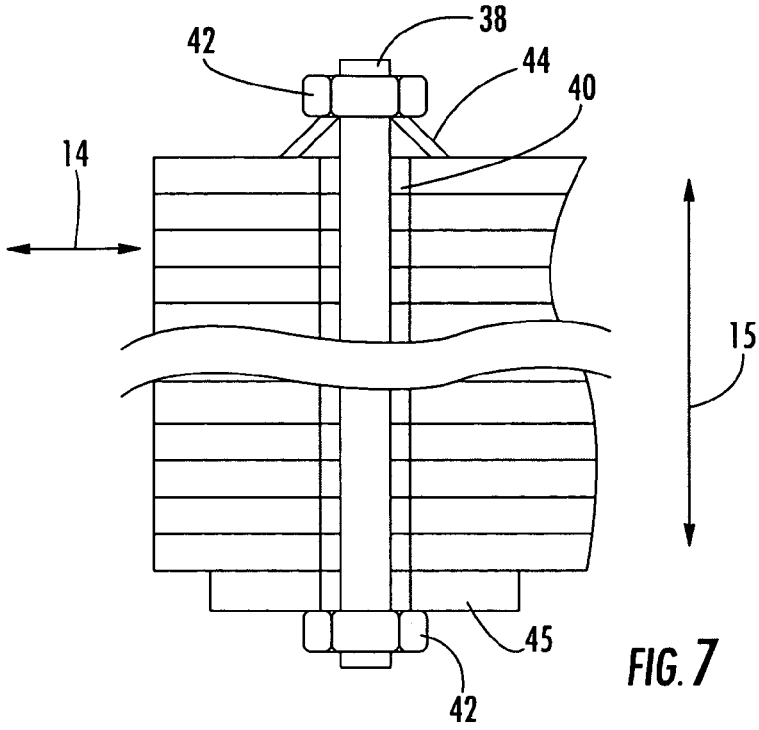
FIG. 7 is a cross-sectional view of a stacked CMC laminate turbine vane according to aspects of the invention, showing a fastening system for radially pre-compressing the laminates in accordance with embodiments of the invention.

The plurality of laminates 12 can be held together in numerous manners. For instance, the stack of laminates 12 can be held together by one or more fasteners including tie rods 38 or bolts, as shown in FIG. 7. In one embodiment, there can be a single fastener. In other embodiments there can be at least two fasteners. To accommodate the fasteners, one or more openings 40 can be provided in each laminate 12 so as to form a substantially radial opening through the vane assembly 10.

The fastener can be closed by one or more retainers to hold the laminate stack together in radial compression. The retainer can be a nut 42 or a cap, just to name a few possibilities. The fastener and retainer can be any fastener structure that can carry the expected radial tensile loads and gas path bending loads, while engaging the vane assembly to provide a nominal compressive load on the CMC laminates 12 for all service loads so as to avoid any appreciable buildup of interlaminar tensile stresses in the radial direction 15, which is the weakest direction of a CMC laminate 12 according to aspects of the invention. The fastener and retainer can further cooperate with a compliant fastener, such as a Bellville washer 44 or conical washer, to maintain the compressive pre-load, while permitting thermal expansion without causing significant thermal stress from developing in the radial direction 15. To more evenly distribute the compressive load on the laminates 12, the fastener and/or retainer can cooperate with a load spreading member 45, such as a washer. The load spreading member 45 can be used with or without a Bellville washer 44 or other compliant fastener.

The fastening system shown in FIG. 7 is especially well suited for vanes 10 that are supported at both the radially inner end 18 and the outer end 16 by shrouds or platforms, as is known in the art. In such case, the vane assembly 10 may behave like a simply supported beam, which can adequately carry the gas path loads at the outer and inner shrouds, making the gas path stresses almost negligible.

However, it should be noted that, in some turbines, the vane assembly 10 may only be supported at one of its radial ends 16,18. For example, the vane assembly 10 may only be supported at its radially outer end 16 by an outer shroud or platform. In such case, the vane 10 may act like a cantilevered beam, and the gas path loads can create a bending moment on the vane 10 in one or more directions, thereby subjecting the vane 10 and/or tie bolts 38 to bending stresses. Over time, such forces may cause creep in the CMC stack and/or in the tie bolts 38. As a result, there can be a reduction or loss of compressive force applied on the laminate stack 10, which, in turn, might lead to coolant losses as well as delamination. Alternative fastening systems according to embodiments of the invention can be provided to address such concerns.

Figure 8A:
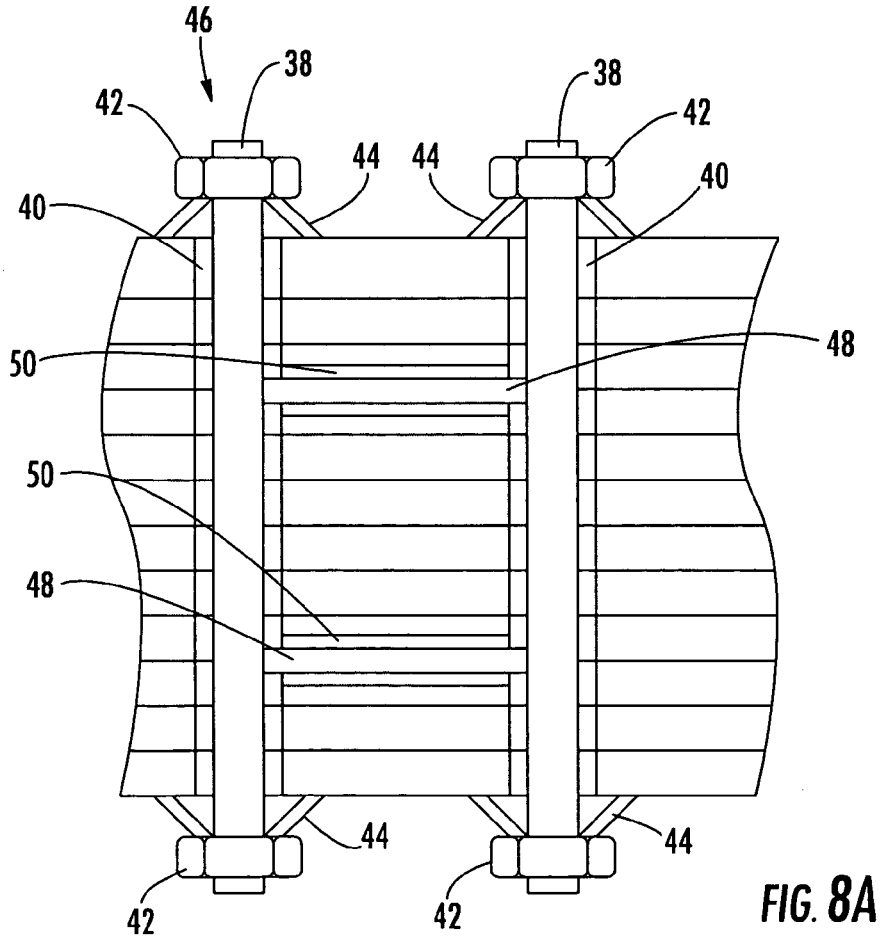
FIG. 8A is a cross-sectional view of a turbine vane according to aspects of the invention, showing a stiffened fastening system in accordance with embodiments of the invention.
Figure 8B:
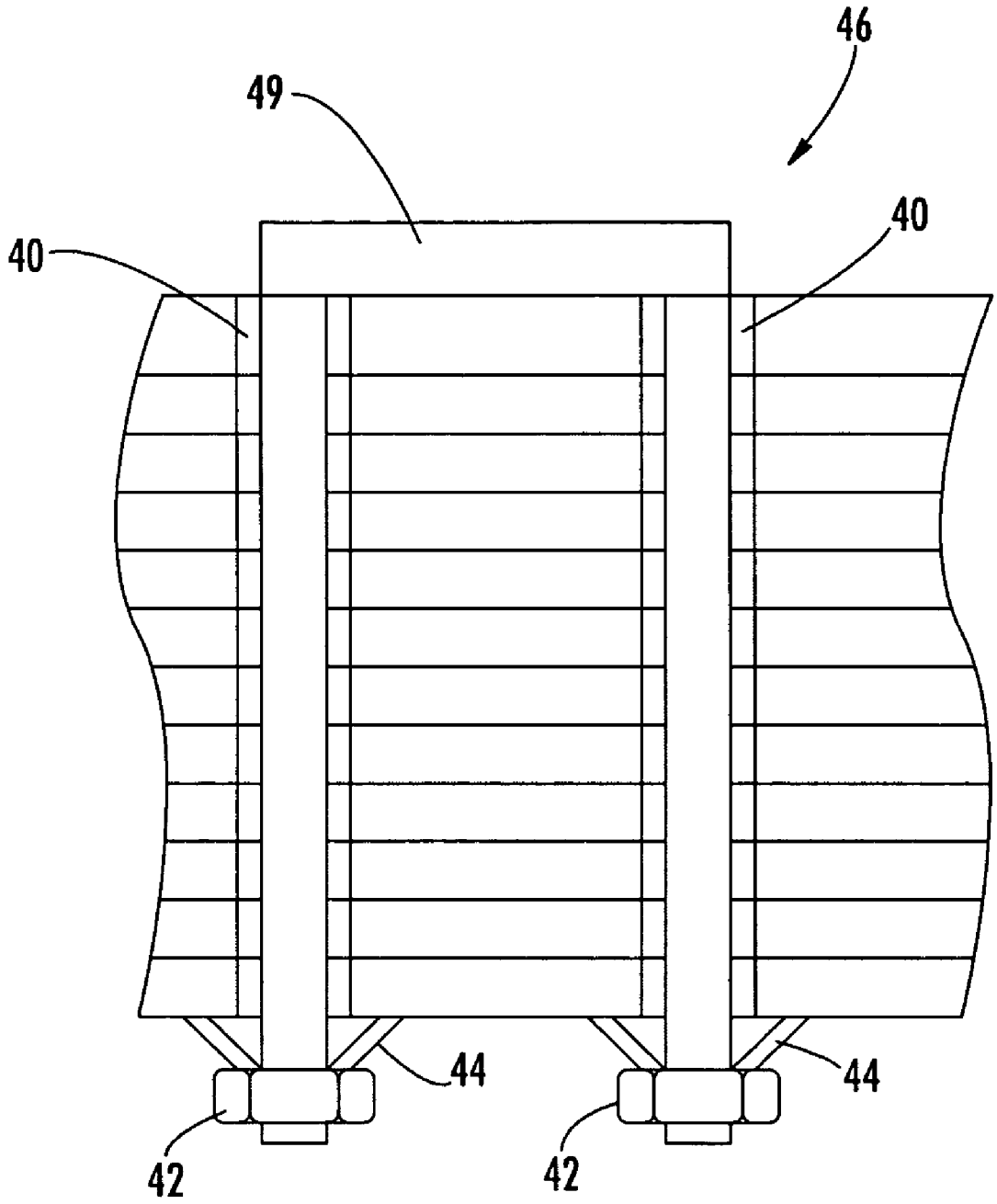
FIG. 8B is a cross-sectional view of a turbine vane according to aspects of the invention, showing an alternative stiffened fastening system in accordance with embodiments of the invention.

One example of such a fastening system is shown in FIGS. 8A and 8B in which multiple fasteners, such as tie rods 38, are secured together to form a single stiffened structure 46. In one embodiment, there can be at least three tie rods 38 joined together to form a rigid integral structure. The tie rods 38 can be joined in any of a number of ways. For example, one or more pins 48 can laterally connect the tie rods 38, as shown in FIG. 8A. The pins 48 can be integral with the tie rods 38 in various ways including welding, brazing or mechanical engagement, just to name a few possibilities. Alternatively, the rigid structure 46 can be formed by joining the tie rods 38 at one of their ends. For instance, as shown in FIG. 8B, a connecting part 49 can connect the tie rods 38. The connecting part 49 can be a separate component, such as a metal block, secured to the tie rods, such as by welding, or the connecting part 49 and tie rods 38 can be unitary. The connecting part 49 can serve a load spreading function as well so as to more evenly distribute the clamping force of the fastening system across the laminates 12.

When such a fastening system is used, the major bending loads can be carried by the stiffened structure 46, which can minimize creep-related concerns. To accommodate such a fastener 46, one or more lateral openings 50 can be provided in the laminates 12. To form the openings 50, material can be removed from a pair of adjacent laminates 12 or from a single laminate 12.

In addition or apart from using fasteners, at least some of the individual laminates 12 can also be bonded to each other. Such bonding can be accomplished by sintering the laminates or by the application of a bonding material between each laminate. For example, the laminates 12 can be stacked and pressed together when heated for sintering, causing adjacent laminates 12 to sinter together. Alternatively, a ceramic powder can be mixed with a liquid to form a slurry. The slurry can be applied between the laminates 12 in the stack. When exposed to high temperatures, the slurry itself can become a ceramic, thereby bonding the laminates 12 together.

In addition to sintering and bonding, the laminates 12 can be joined together through co-processing of partially processed individual laminates using such methods as chemical vapor infiltration (CVI), slurry or sol-gel impregnation, polymer precursor infiltration & pyrolysis (PIP), melt-infiltration, etc. In these cases, partially densified individual laminates are formed, stacked, and then fully densified and/or fired as an assembly, thus forming a continuous matrix material phase in and between the laminates.

It should be noted that use of the phrase "at least one of co-processing, sintering and bonding material," as used herein, is intended to mean that only one of these methods may be used to join individual laminates together, or that more than one of these methods can be used to join individual laminates together. Providing an additional bond between the laminates (whether by co-processing, sintering or having bonding material between each laminate 12) is particularly ideal for highly pressurized cooled vanes where the cooling passages require a strong seal between laminates 12 to contain pressurized coolant, such as air, flowing through the interior of the vane assembly 10.

However, for designs in which little pressure is required in the vane interior, the mechanical clamping pressure of the fasteners may be sufficient by itself. For instance, during turbine operation, the outer peripheral edges 30 of the laminates 12 are typically the hottest region of a given vane cross section. Consequently, the thickness of each laminate 12 would expand at or near the outer peripheral edge 30 due to thermal expansion. Thus, the laminates 12 would primarily engage each other at or near their outer peripheral edges 30. In such case, the clamping load from the tie rods 38 would be focused greatest around the outer perimeter of the laminates 12, thereby providing sufficient mechanical sealing for low internal pressure loads.

The airfoil-shaped CMC laminates 12 according to embodiments of the invention can be made in a variety of ways. Preferably, the CMC material is initially provided in the form of a substantially flat plate. From the flat plate, one or more airfoil shaped laminates can be cut out, such as by water jet or laser cutting. Flat plate CMC can provide numerous advantages. At the present, flat plate CMC provides one of the strongest, most reliable and statistically consistent forms of the material. As a result, the design can avoid manufacturing difficulties that have arisen when fabricating tightly curved configurations. For example, flat plates are unconstrained during curing and thus do not suffer from anisotropic shrinkage strains. Ideally, the assembly of the laminates in a radial stack can occur after each laminate is fully cured so as to avoid shrinkage issues. Flat, thin CMC plates also facilitate conventional non-destructive inspection. Furthermore, the method of construction reduces the criticality of delamination-type flaws, which are difficult to find. Moreover, dimensional control is more easily achieved as flat plates can be accurately formed and machined to shape using cost-effective cutting methods. A flat plate construction also enables scaleable and automatable manufacture.

The operation of a turbine is well known in the art as is the operation of a turbine vane. During operation, a turbine vane can experience high stresses in three directions—in the radial direction 15 and in the planar direction 14 (which encompasses the axial and circumferential directions of a vane relative to the turbine). A vane according to aspects of the invention is well suited to manage such a stress field.

In the planar direction 14, high stresses can arise because of thermal gradients between the hot exterior vane surface and the cooled vane interior. The thermal expansion of the vane exterior and the thermal contraction of the vane interior places the vane in tension in the planar direction 14. However, a vane assembly 10 according to embodiments of the invention is well suited for such loads because, as noted above, the fibers 34 in the CMC are aligned in the planar direction 14, giving the vane 10 sufficient planar strength or strain tolerance. Such fiber alignment can also provide strength against pressure stresses that can occur in the turbine.

In the radial direction 15, thermal gradients and aerodynamic bending forces can subject the vane 10 to high radial tensile stresses. While relatively weak in radial tension, a vane 10 according to embodiments of the invention can take advantage of the though thickness compressive strength of the laminates 12 (that is, the radial compressive strength of the vane 10) to counter the radial forces acting on the vane 10. To that end, the vane 10 can be held in radial compression at all times by tie bolts 38 or other fastening system. As a result, radial tensile stresses on the vane 10 are minimized.

During operation, the vane assembly 10 can be exposed to high temperatures, so the vane assembly 10 may require cooling. One cooling scheme that can be used in connection with a vane assembly 10 according to aspects of the invention is shown in FIG. 1. In one embodiment, a plurality of substantially radial cooling passages 52 can extend through the vane assembly 10. The cooling passages 52 can be provided along at least a portion of the vane 10. As shown in FIG. 1, the passages 52 can extend about the entire vane 10, generally following the outer peripheral surface 20. Ideally, the cooling passages 52 can be provided near the outer peripheral surface 20 of the vane 10. Such near-surface cooling can reduce the level of thermal stress and reduce cooling requirements. Further, such a cooling system is favorable because such relatively small cooling passages detract little from the planar strength properties of the vane 10. In one embodiment, the passages 52 can be about 3 millimeters in diameter.

The individual cooling passages 52 can be any of a number of cross-sectional shapes including, for example, circular, elliptical, elongated, polygonal and square. Preferably, the passages 52 can all be substantially identical, but one or more of the passages 52 can be different at least in terms of its geometry, size, position, and orientation through the vane 10. The passages 52 can be provided according to a pattern, regular or otherwise, or they may be provided according to no particular pattern. In one embodiment, the holes 52 can be spaced equidistantly about the vane, relative to each other and/or to the outer peripheral surface 20. The shapes and pattern of the holes 52 can be optimized for each application, if necessary, to minimize stress and to increase robustness of the design.

Coolant for the passages 52 can be routed from a high pressure air source near the outer shroud. The coolant can flow radially through the cooling passages 52 from the radial outer end 16 to the radial inner end 18. Once the coolant reaches the end of the passages 52 at the radial inner end 18 of the vane 10, the coolant can be routed to the trailing edge 24 for discharge into the gas path or it can be dumped at one or more points on the inner shroud or platform, as will be understood by one skilled in the art.

Figure 6:
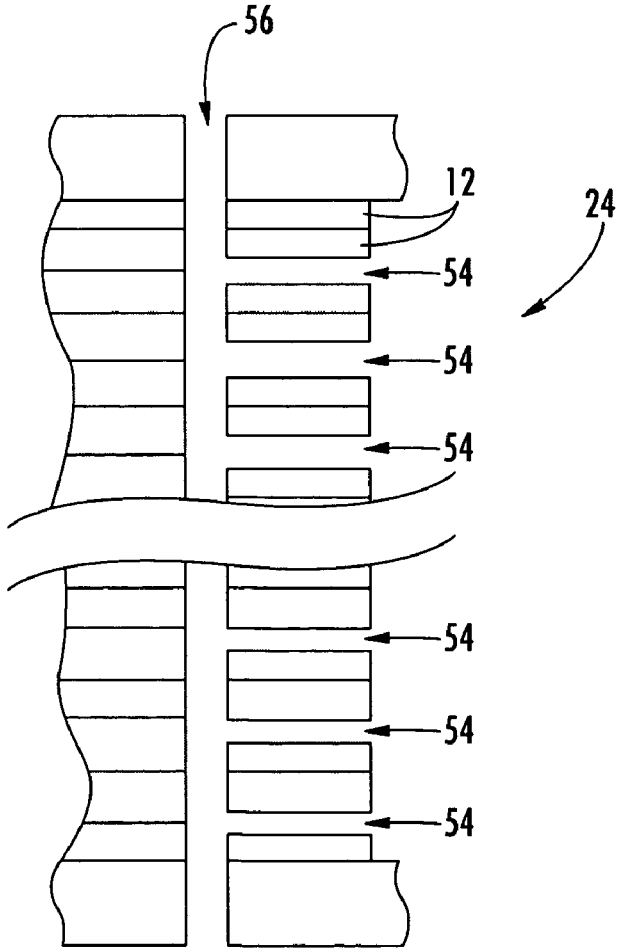
FIG. 6 is a cross-sectional view of a stacked CMC laminate turbine vane according to aspects of the invention, showing a trailing edge cooling system.

For cases where greater cooling is required at the trailing edge 24 of the vane 10, trailing edge exit passages 54 can be provided in one or more of the laminates 12, such as those shown in FIG. 6. The passages 54 can have any of a number of shapes including round, rectangular or polygonal, to name a few. The passages 54 can be provided by including in-plane cutouts or openings in the trailing edge of one or more of the laminates 12. For example, some of the exit passages 54 can be formed by providing an opening in a single laminate 12 (such as the bottom passages 54 shown in FIG. 6). Alternatively, the passages 54 can be formed by removing material from a pair of adjacent laminates 12 (such as the top passages 54 shown in FIG. 6). The passages 54 can be supplied with coolant from a larger cooling hole, which acts as a plenum design to supply sufficient cooling air reservoir. The supply cooling hole can be, for example, one of the openings 40 provided for receiving a tie bolt 38 or other fastener. Alternatively, a separate opening 56 can be provided dedicated solely as a coolant supply plenum.

The cooling passages 52,54 can be formed in a number ways including water jet cutting, laser cutting, stamping, die-cutting, drilling or any other machining operation. Alternatively, the passages 52,54 can be formed by inserting fugitive rods or pins through a semi-cured CMC plate. The fugitive rods can remain in the partially cured laminate; later, the laminate can be heated to fully cure the laminate. In such case, the fugitive material can be removed, such as by burning or melting prior to or during laminate curing, thereby leaving the passages 52,54 behind.

The stacked laminate vane design lends itself to the inclusion and implementation of various preferred features, some of which will be discussed below. For example, in some instances, it may be desirable to afford greater thermal protection for the vane assembly 10. In such case, one or more layers of a thermal insulating material or a thermal barrier coating can be applied around the outside surface of the vane 10. In one embodiment, the thermal barrier coating can be a friable graded insulation (FGI) 58, which is known in the art, such as in U.S. Pat. Nos. 6,670,046 and 6,235,370, which are incorporated herein by reference. When such the FGI 58 substantially covers at least the outer peripheral surface 20 of the vane assembly 10, the thermal gradient across the vane 10 in the planar direction 14 can be reduced.

Figure 16:
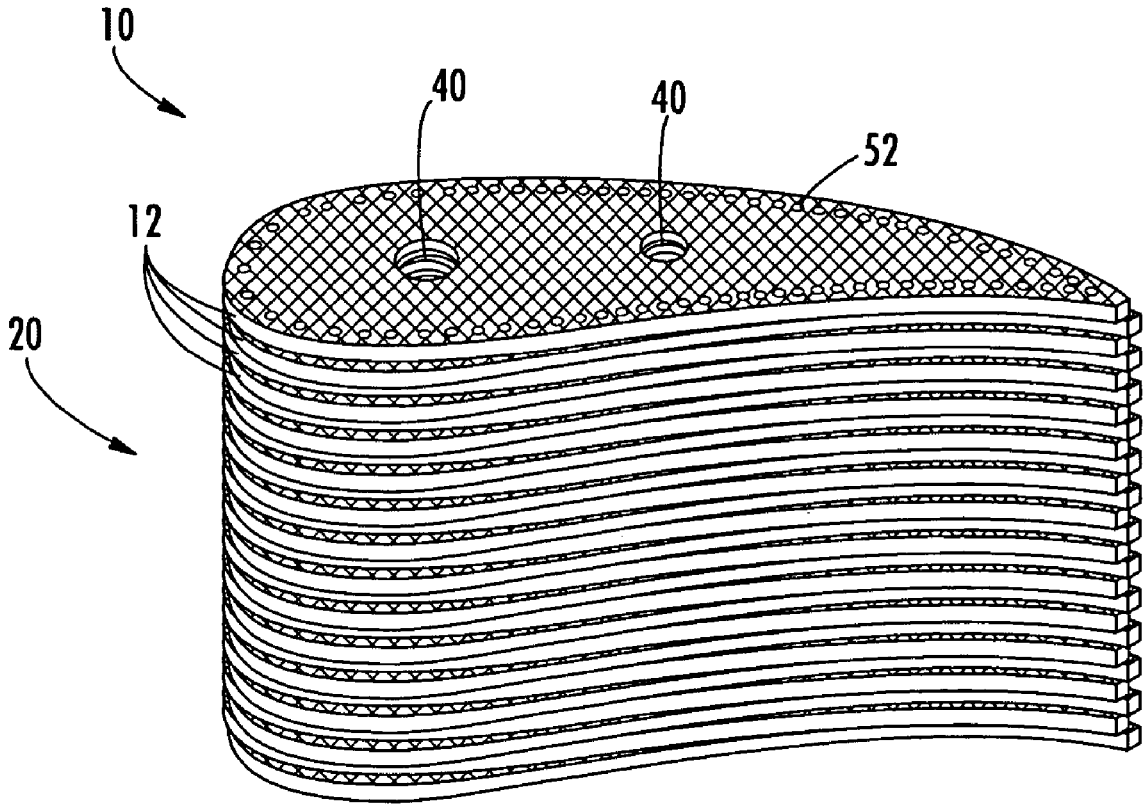
FIG. 16 is an isometric view of a turbine vane formed by staggered laminates in accordance with aspects of the invention.

Experience has revealed difficulty in bonding thermal insulating materials, such as FGI 58, to smooth surfaces. Therefore, one or more laminates 12 according to embodiments of the invention can include a number of features to facilitate bonding of the thermal insulating material to the outer peripheral surface 20 of the vane assembly 10. For example, the outer peripheral edge 30 of each laminate 12 can have a rough finish after it is cut from a flat plate. That is, the outer peripheral edges 30 of the laminates 12 are not substantially smooth. Further, the laminates can be stacked in a staggered or offset manner to create an uneven outer peripheral surface 20, as shown in FIG. 16. In such case, the openings 40 and/or the cooling passages 52 (not shown) can be enlarged or repositioned as necessary in individual laminates 12 so as to align in the staggered assembly.

Figure 15A:
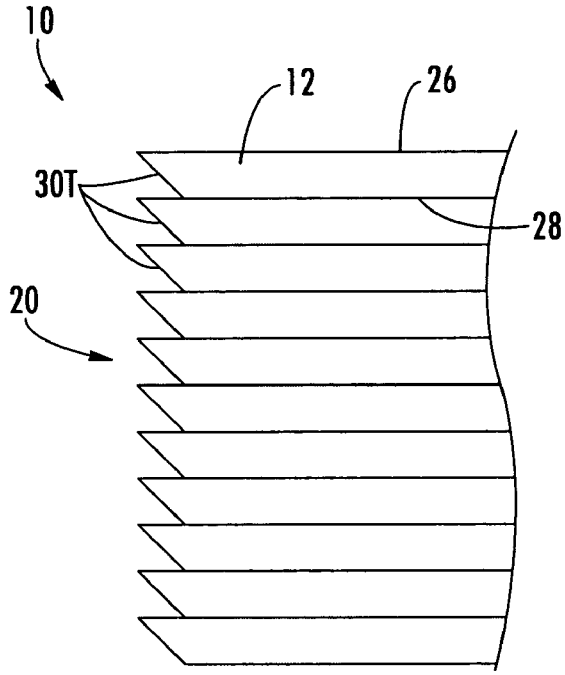
FIG. 15A is a cross-sectional view of a turbine vane according to aspects of the invention, showing a plurality of laminates having a tapered outer peripheral edge and stacked so that the taper of each laminate extends in substantially the same direction.

Alternatively or in addition to the above, the outer peripheral edges of the laminates 12 can be tapered 30T. Such tapered edges 30T can be formed when the airfoil shaped laminate 12 is cut from a flat plate. In one embodiment, the laminates 12 can be stacked such that the direction of the tapered outer peripheral edge 30 of each laminate 12 extends in substantially the same direction. For example, as shown in FIG. 15A, the laminates can be arranged so that the outer peripheral edge 30T of each laminate 12 tapers in from the top surface 26. As a result, the outer peripheral surface 20 of the vane assembly 10 can be stepped or, in cross-section, generally saw-toothed.

Figure 15B:
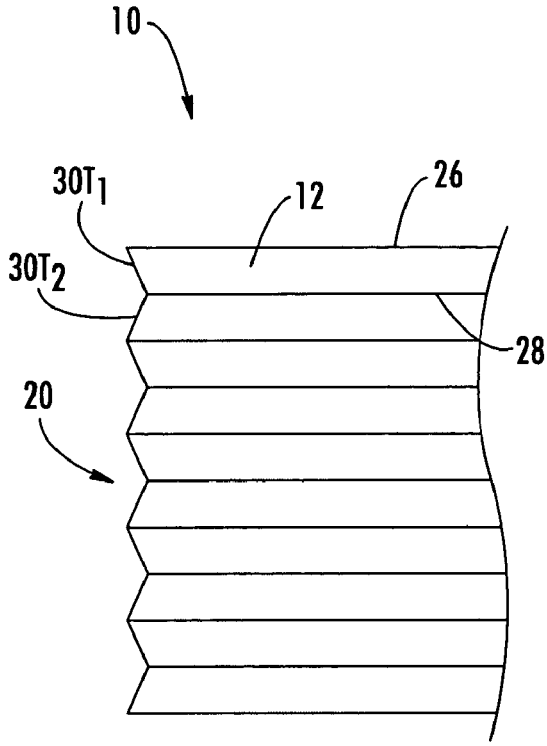
FIG. 15B is a cross-sectional view of a turbine vane according to aspects of the invention, showing a plurality of laminates having tapered outer peripheral edges and stacked so that the taper of one laminate extends in the opposite direction of the tapers on the neighboring laminates.

Alternatively, the laminates 12 can be stacked such that, with respect to adjacent laminates, the tapered outer peripheral edges 30T extend in opposite directions. For example, as shown in FIG. 15B, the laminates 12 can be arranged so that the outer peripheral edge 30T1 of one laminate 12 tapers inward from the top surface 26. The adjacent laminate 12 can have an outer peripheral edge 30T2 that tapers in from the bottom surface 26 (or, stated differently, an outer peripheral edge 30T2 that flares out from the top surface 26). Such an arrangement can alternate throughout the laminate stack or can be provided in local areas. When such opposing tapers 30T1,30T2 are provided, the outer peripheral surface 20 of the vane assembly 10 can be non-smooth and, in cross-section, generally zigzagged.

Figure 11:
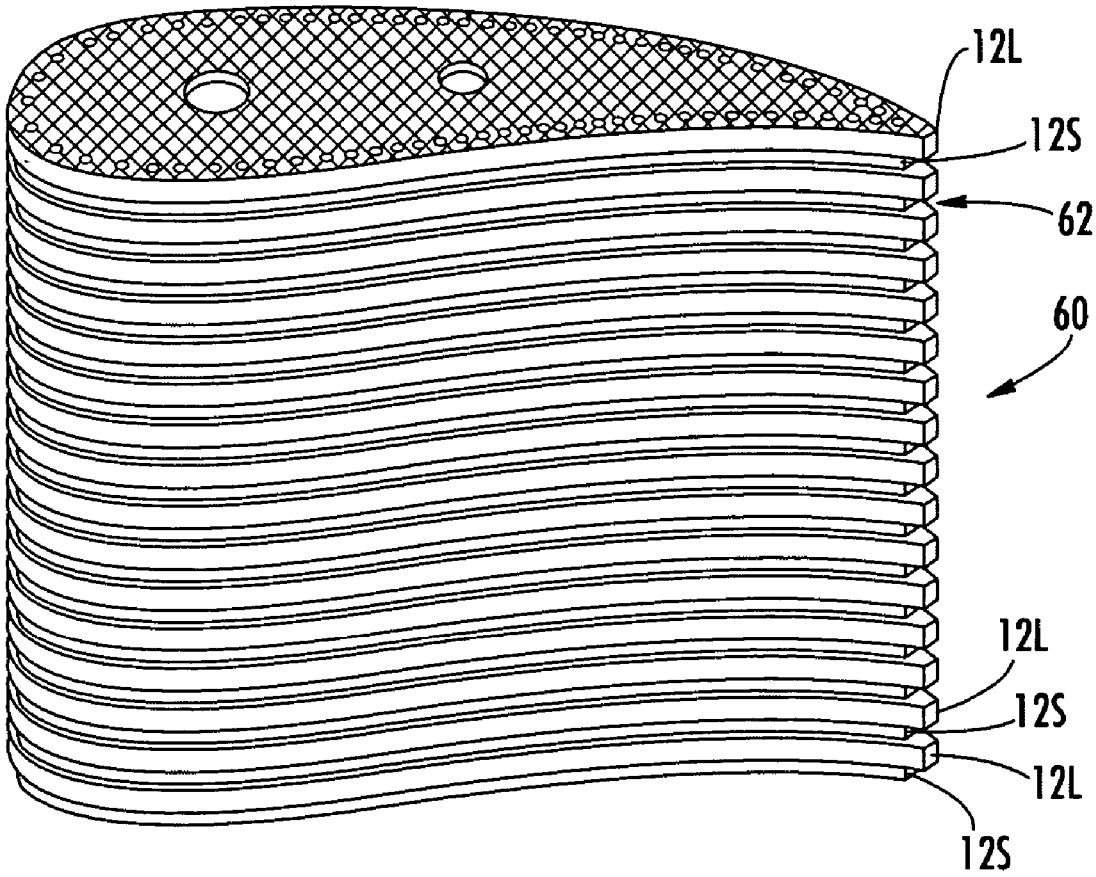
FIG. 11 is an isometric view of a turbine vane having a stepped outer peripheral surface formed by alternating large and small laminates in accordance with aspects of the invention.

In other instances, particularly when greater bonding is required, the CMC laminates 12 can be cut at slightly different sizes so that the stacked vane 10 has a stepped outer surface 60, as shown in FIG. 11. For example, the vane 10 can be assembled so that a large laminate 12L alternates with a small laminate 12S to form the stepped outer surface 60. The large laminates 12L and the small laminates 12S can be substantially geometrically similar, differing in their size in the in-plane direction. That is, the terms "large" and "small" are intended to refer to the relative size of the outer peripheral surface 30 of a laminate. The large laminates 12L can be slightly larger than the small laminates 12L, such that when stacked, a large laminate 12L may overhang a small laminate 12S, for example, by about 2 millimeters around the entire outer peripheral edge of the laminate. Thus, when the thermal insulating material is applied to the stepped outer peripheral surface 60 of the vane assembly 10, the stepped exterior 60 can act as pins to mechanically assist in holding the material to the exterior of the vane 10. When applied, the thermal insulating material can fill in the gaps 62 created by the alternating sized laminates 12L, 12S.

Figure 12:
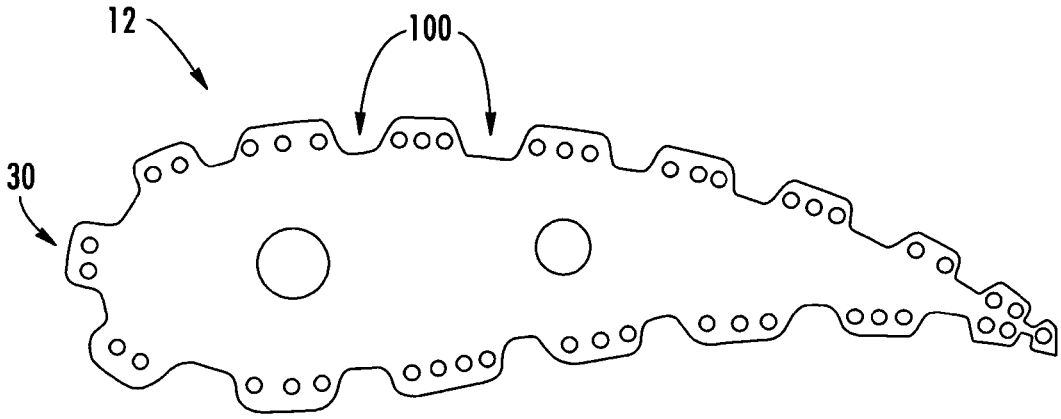
FIG. 12 is a top plan view of a single CMC laminate according to aspects of the invention, showing a series of recesses in the outer peripheral edge of the laminate.
Figure 13:
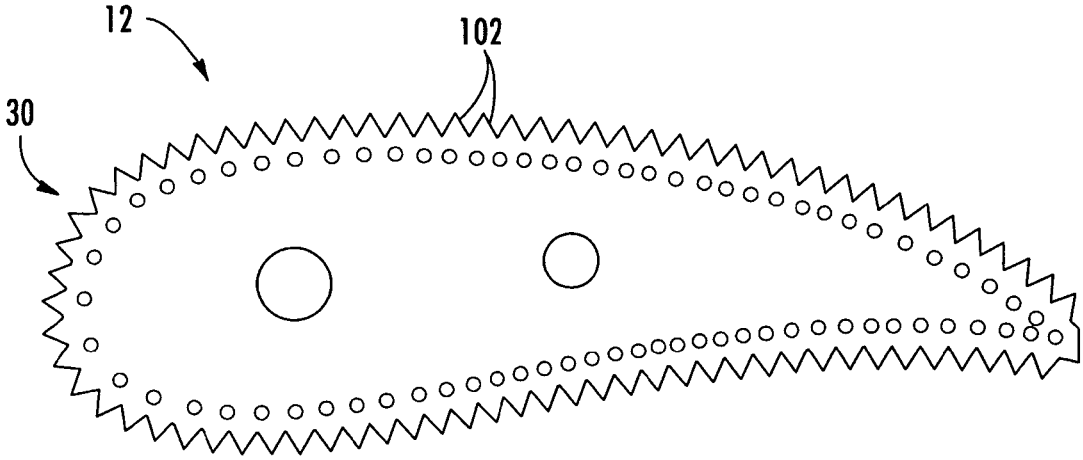
FIG. 13 is a top plan view of a single CMC laminate according to aspects of the invention, showing a serrated outer peripheral edge of the laminate.
Figure 14:
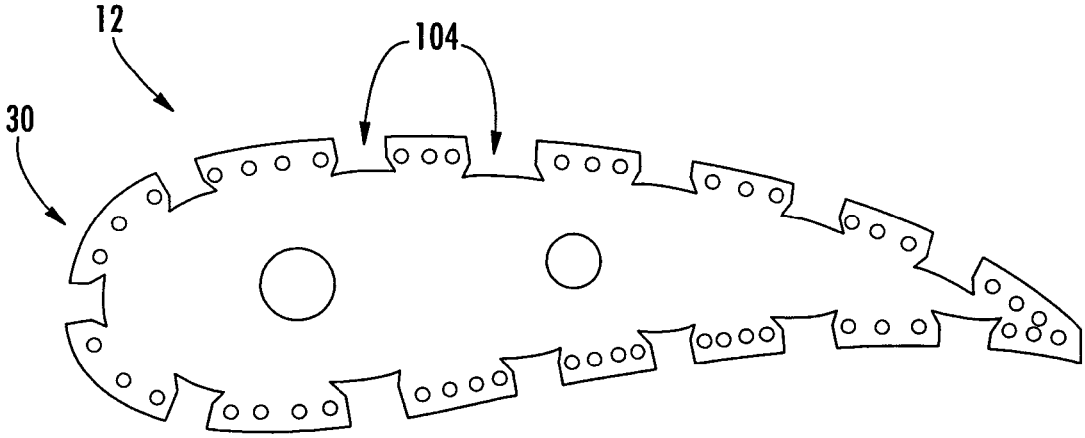
FIG. 14 is a top plan view of a single CMC laminate according to aspects of the invention, showing a series of dove-tail cutouts in the outer peripheral edge of the laminate.

A host of features can be provided in the outer peripheral surface 18 of one or more laminates 12 to facilitate bonding of a thermal insulating material to the outer peripheral surface 20 of the vane assembly 10, as shown in FIGS. 12–14. For example, the outer peripheral surface of one of more of the laminates 12 in the stack can have an outer peripheral surface that includes one or more recesses 100 (FIG. 12), serrations 102 (FIG. 13) and/or cutouts such as dovetail cutouts 104 (FIG. 14).

The recesses 100 can be provided about a portion of the outer peripheral edge 30 of a laminate 12 or about the entire periphery 30 of the laminate 12. In addition, the recesses 100 can be provided at regular or irregular intervals. The recesses 100 can be substantially identical to each other, or one or more recesses 100 can be different from the other recesses 100 at least with respect to their width, depth and conformation.

Again, at least one of the laminates 12 in the stack can have the recesses 100. In one embodiment, each of the laminates 12 can include the recesses 100. When adjacent laminates 12 are provided with recesses 100, the recesses 100 can be substantially aligned with each other or they can be offset. When the recesses 100 are offset, the recesses 100 of one laminate 12 may or may not overlap with the recesses 100 in the adjacent laminate 12. Alternatively, a vane assembly 10 can be formed in which regular, or non-recessed, airfoil-shaped laminates 12 (like the laminate in FIG. 2) can alternate with laminates 12 having recesses 100, so as to form an irregular outer peripheral surface 20 to facilitate bonding of a thermal insulating material. While the above discussion has been in the context of recesses, the discussion equally applies to laminates 12 having serrations 102 and/or cutouts as well.

The recesses 100, serrations 102, and cutouts 104 can be used separately or in combination. The phrase "at least one of recesses, serrations and cutouts," as used herein, means that a laminate can have one or more of these features. For purposes of forming a vane assembly 10 with an irregular outer peripheral surface 20, such features can also be used in combination with any of the features disclosed in FIG. 11 (alternating large and small laminates 12L, 12S), FIG. 15 (tapered outer peripheral edges 30T) and FIG. 16 (staggered laminates). Again, the above features are provided in the way of examples, and one skilled in the art will readily appreciate that other features and conformations can be used to form a non-smooth outer peripheral surface 20 of the vane assembly 10.

Figure 5:
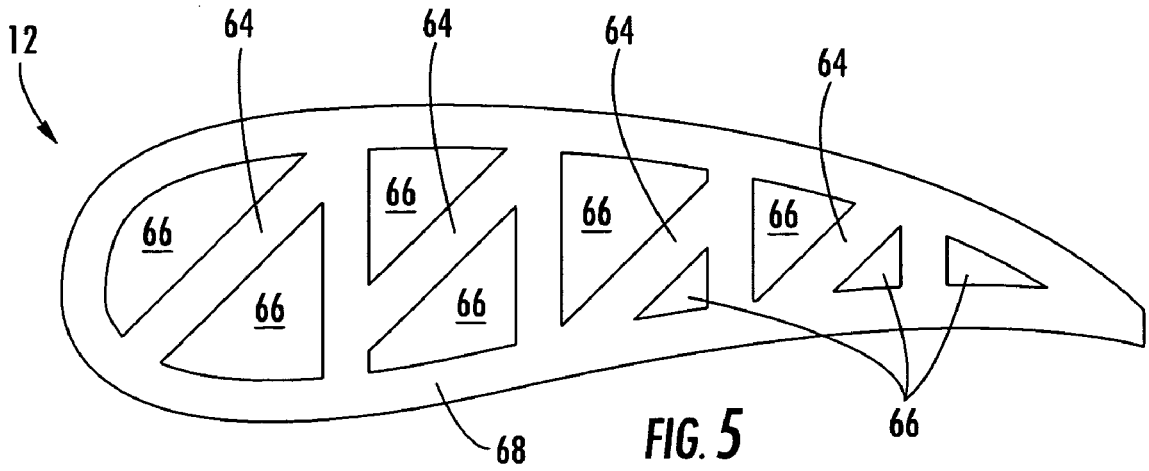
FIG. 5 is a top plan view of a CMC laminate with spars according to aspects of the invention.

In addition, desirable features that are difficult to achieve in a vane can be readily formed in a CMC laminate according to aspects of the invention. For example, ribs or spars that connect the pressure-side and suction-side of the airfoil are difficult to form in typical two dimensional laminate lay-up (wrapping) construction. U.S. Pat. No. 5,306,554, which is incorporated herein by reference, discloses an airfoil having ribs. Such ribs can result in moderate thermal stresses due to temperature differences between the cool rib and the hot airfoil skin. The stresses resulting from thermal and internal pressure are sufficient to create problems at the triple points (reference no. 25 in U.S. Pat. No. 5,306,554) of the construction. However, as shown in FIG. 5, one or more ribs 64 can be formed in a vane assembly 10 according to embodiments of the invention by providing radial cutouts 66 in one or more of the laminates 12 in the vane assembly 10. In this case, the fibers 34 of the CMC can be oriented so as to reinforce the junction of the rib 64 and outer wall 68.

Figure 4:
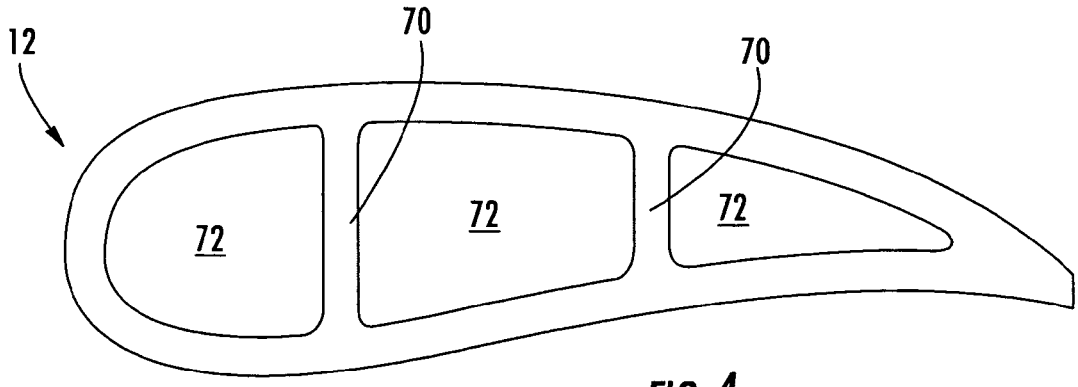
FIG. 4 is a top plan view of a CMC laminate with ribs according to aspects of the invention.

Further, it is known in the art that an airfoil having a parted spar arrangement can reduce thermal stresses. For example, U.S. Pat. No. 6,398,501, which is incorporated herein by reference, describes the intermittent use of spars in an airfoil to minimize radial thermal stresses. Such features, while desirable, are difficult to provide in an airfoil. However, as shown in FIG. 4, spars can be readily included in a CMC laminate according to aspects of the invention. The potential reduction of radial thermal stresses offered by such spars is desirable in a vane assembly 10 according to aspects of he invention because the radial direction is the weak material direction of the stacked CMC laminates. One or more spars 70 can be formed by one or more through thickness cutouts 72 in at least one of the laminates 12. Moreover, the inclusion of one or more spars 70 may not affect the in-plane strength of the laminate 12 or the planar strength of the vane. In one embodiment, at least one of the laminates 12 in a vane assembly 10 according to embodiments of the invention can have at least one spar 70. In other embodiments, the laminates 12 in the vane assembly 10 can alternate between those with a spar 70 and those without a spar 70.

The foregoing description is provided in the context of one vane assembly according to embodiments of the invention. Of course, aspects of the invention can be employed with respect to myriad vane designs, including all of those described above, as one skilled in the art would appreciate. Embodiments of the invention may have application to other hot gas path components of a turbine engine. For example, the same stacked laminate construction can be applied to the inner and outer platforms or shrouds of the vane by changing the shape of the laminates so as to build up the required platform or shroud geometry. Thus, it will of course be understood that the invention is not limited to the specific details described herein, which are given by way of example only, and that various modifications and alterations are possible within the scope of the invention as defined in the following claims.

What is claimed is:

1. A ceramic matrix composite laminate comprising:

a laminate having an airfoil-shaped outer peripheral surface, the laminate having an in-plane direction and a through thickness direction, the through thickness direction being substantially normal to the in-plane direction, the laminate being made of an anisotropic ceramic matrix composite (CMC) material, wherein the in-plane tensile strength of the laminate is substantially greater than the through thickness tensile strength of the laminate.

2. The laminate of claim 1 wherein the in-plane tensile strength is at least three times greater than the through thickness tensile strength.

3. The laminate of claim 1 wherein the CMC material includes a ceramic matrix and a plurality of fibers therein, wherein substantially all of the fibers are oriented substantially in the in-plane direction of the laminate.

4. The laminate of claim 3 wherein a first portion of fibers extend in a first in-plane direction and a second portion of fibers extend in a second in-plane direction, wherein the first and second in-plane directions are oriented at about 90 degrees relative to each other.

5. The laminate of claim 1 wherein the laminate includes through thickness cutouts so as to form one of a rib or a spar in the laminate.

6. The laminate of claim 1 wherein the laminate includes at least one of recesses, serrations and cutouts about at least a portion of the outer peripheral surface.

7. A turbine vane assembly comprising:

a plurality of airfoil-shaped laminates radially stacked so as to define a turbine vane, the vane having an outer peripheral surface and a planar direction and a radial direction, the radial direction being substantially normal to the planar direction, wherein each laminate is made of an anisotropic ceramic matrix composite (CMC) material such that the planar tensile strength of the vane is substantially greater than the radial tensile strength of the vane.

8. The vane assembly of claim 7 wherein the planar tensile strength is at least three times greater than the radial tensile strength.

9. The vane assembly of claim 7 wherein the CMC material includes a ceramic matrix and a plurality of fibers therein, wherein substantially all of the fibers are oriented substantially in the planar direction of the vane.

10. The vane assembly of claim 9 wherein the fibers are arranged in two planar directions in the vane, a first portion of the fibers extend in a first planar direction and a second portion of the fibers extend in a second planar direction, wherein the first and second planar directions are oriented at about 90 degrees relative to each other.

11. The vane assembly of claim 9 wherein at least one pair of adjacent laminates have a uni-directional fiber arrangement, the pair of laminates including a first laminate and a second laminate, substantially all of the fibers in the first laminate extend in a first planar direction, substantially all of the fibers in the second laminate extend in a second planar direction, and wherein the first and second planar directions are oriented at about 90 degrees relative to each other.

12. The vane assembly of claim 7 further including a fastening system including an elongated fastener and a retainer, the fastener extending radially through a radial opening provided in the vane, wherein at least one end of the fastener is closed by the retainer so as to hold the plurality of laminates in radial compression.

13. The vane assembly of claim 7 further including a stiffened fastening system including at least two tie rods extending radially through at least one opening provided in the vane, the tie rods being joined so as to form a single rigid fastener, wherein the ends of the tie rods are closed by retainers so as to hold the plurality of laminates in radial compression, whereby the stiffened fastener system can reduce the possibility of radial creep of the fasteners and laminates.

14. The vane assembly of claim 7 wherein the plurality of laminates includes alternating large laminates and small laminates so as to form a vane having a stepped outer peripheral surface.

15. The vane assembly of claim 7 wherein at least one of the laminates is staggered from the other laminates so as to form a vane with an irregular outer peripheral surface.

16. The vane assembly of claim 7 wherein each of the laminates in the stack has an outer peripheral edge, wherein at least two of the laminates have a tapered outer peripheral edge.

17. The vane assembly of claim 7 wherein the laminates form an irregular outer peripheral surface of the vane.

18. The vane assembly of claim 17 further including a thermal insulating material applied over the outer peripheral surface of the vane.

19. The vane assembly of claim 7 wherein at least one pair of adjacent laminates are joined by at least one of co-processing, sintering and bonding material applied between the laminate pair.

20. The vane assembly of claim 7 further including a coolant supply opening extending radially in the vane, wherein each of the laminates have a leading edge and a trailing edge, wherein at least one of the laminates includes a channel extending from the trailing edge and into fluid communication with the coolant supply opening, whereby a coolant can be provided to the trailing edge of the vane assembly.

* * * * *